United States Patent [19]

Avery

[11] 4,144,690

[45] * Mar. 20, 1979

[54] CONCRETE FORMING STRUCTURES

[75] Inventor: Peter J. Avery, Toronto, Canada

[73] Assignee: Aluma Building Systems Incorporated, Downsview, Canada

[ * ] Notice: The portion of the term of this patent subsequent to Jan. 22, 1991, has been disclaimed.

[21] Appl. No.: 862,278

[22] Filed: Dec. 19, 1977

[51] Int. Cl.[2] ..... E04H 12/34; E04B 5/00

[52] U.S. Cl. ..... 52/376; 52/729; 52/731

[58] Field of Search ..... 52/364–376, 52/690–693, 730–732, 729; 249/18

[56] References Cited

U.S. PATENT DOCUMENTS

| | | | |
|---|---|---|---|
| 1,586,053 | 5/1926 | Snyder | 52/738 |
| 1,619,300 | 3/1927 | Klaasen | 52/376 |
| 1,694,514 | 12/1928 | Naugle et al. | 52/692 |
| 2,167,835 | 8/1939 | Greulich | 52/376 |
| 2,167,836 | 8/1939 | Greulich | 52/376 |
| 2,182,015 | 12/1939 | Davis | 52/376 |
| 3,336,708 | 8/1967 | Rambelle | 52/376 |
| 3,774,366 | 11/1973 | Baker | 52/729 |
| 3,899,152 | 8/1975 | Avery | 249/18 |

FOREIGN PATENT DOCUMENTS

| | | | |
|---|---|---|---|
| 804716 | 4/1951 | Fed. Rep. of Germany | 52/376 |
| 637844 | 5/1950 | United Kingdom | 52/376 |
| 650239 | 2/1951 | United Kingdom | 52/463 |

*Primary Examiner*—James L. Ridgill, Jr.
*Attorney, Agent, or Firm*—Donald E. Hewson

[57] ABSTRACT

Concrete forming structures are provided particularly for use as horizontal floor forms or vertical wall forms. All such forms have a plurality of beam members placed across and secured to additional structural members such as trusses or stiffeners. Each beam is usually formed of extruded aluminum, and has an upper portion which has an open section in which an independent beam stiffening joist member may be secured. Sheeting, such as plywood panels which are usually used for concrete forming, may be nailed or screwed to a concrete forming structure at the independent beam stiffening joist members, which are usually wood. The deflection resistance of a beam having a wooden beam stiffening joist member secured in its upper portion is improved over that of a standard I-beam having an equal cross-sectional area of the same metal. Any of the concrete forming structures may be removed from the concrete when it has sufficiently cured, and "flown" using known construction cranes to another working position which may be several storeys above the floor from which it has just been removed.

13 Claims, 11 Drawing Figures

CONCRETE FORMING STRUCTURES

This is a continuation of application Ser. No. 468,454, filed May 9, 1974 now abandoned, which was a division of application Ser. No. 434,827, filed Jan. 18, 1974, now U.S. Pat. No. 3,899,152, which was a continuation-in-part of U.S. patent application Ser. No. 204,132 filed Dec. 2, 1971, now U.S. Pat. No. 3,787,020.

FIELD OF THE INVENTION

This invention relates to a concrete forming structure. In particular, the invention relates to a concrete forming structure for use in construction of buildings which have poured concrete floors or walls, and is of the sort of concrete forming structure known as "flying forming". The present invention provides beam members for use in concrete forming structures, and contemplates such structures particularly being comprised of extruded aluminum members.

BACKGROUND OF THE INVENTION

Very often buildings which are being constructed, particularly high-rise buildings such as apartments and office buildings, have poured concrete floors; and such buildings may also have poured concrete pillars, columns and walls, as well as special poured-in-place drop-beams and spandrels. The thickness or amount of concrete which is poured to form a floor may be up to eight inches, depending on the span of the floor between supporting walls or columns and sometimes more. In any event, in most instances, concrete floors are poured in spans of 11 to 26 feet, usually about 20, which are between supporting walls or columns. Usually, at about the same time as a floor is poured, the walls or columns for the next higher floor are also placed or poured. However, during the construction of a high-rise building, it is necessary to provide forming structures particularly to support each of the concrete floors and walls as they are poured, and for the next few days following when they are poured, so as to permit the concrete to cure sufficiently in order to remove the forming structure therefrom. In the case of poured concrete floors, the floors may then be re-shored with temporary single-point jacks or pillars to assist in carrying floor loading as the concrete continues to cure to its ultimate strength.

Most often, a concrete floor in a high-rise building is made by pouring the concrete on a form which is supported on the floor beneath the one being poured, which form provides a substantially flat or planar upper deck on which the concrete is poured. When the concrete forming structure is subsequently removed after the flooring has cured, each span of the floor is carried between columns or shear walls, with spans up to eighteen feet and sometimes greater, and having a depth which is the front-to-back dimension of the building being constructed. Very often, therefore, concrete floors are poured in bays having dimensions of twenty feet by eighty feet or more between columns or supporting walls. As noted, the floors may at first be re-shored when the concrete forming structures are removed from beneath them, but the re-shoring is only temporary. An entire floor may have a number of bays.

It is desirable to move the concrete forming structure on which a concrete floor is poured as easily as possible; and this is most easily accomplished by moving the concrete forming structure substantially as one integral structure. Otherwise, it is necessary to provide a plurality of forms including steel or wooden crib-like structures, or scaffolding, and individual plywood sheeting to form the deck on which the concrete is poured, etc. The same is also true of wall forming structures.

When the concrete forming structure can be moved in substantially one operation as one integral structure, labour costs can be considerably reduced — both in respect of set-up time and knock-down time — as well as in the use of labourers rather than semi-skilled or skilled tradesmen and journeymen. Thus, flying forming systems have been developed whereby a concrete forming structure is built as a single, monolithic or integral structure having trusses, beams and a deck which all comprise a single structural entity. For wall forming, the form comprises stiffeners, beams and a face. The flying form is so called because it can be "flown" from one bay to another using tower, mobile, or self-climbing cranes of the types well known in the construction industry. A high-rise building may therefore be constructed using a plurality of flying forming structures as concrete forming structures in the following manner:

When the first floor at or slightly above ground level has been poured on suitable concrete forming structures, a plurality of horizontal flying forms for floor forming are placed on it, one or more for each bay as discussed hereafter, depending on the type of flying form and depending on the materials to be used. Forming for poured walls or columns is also put in place. Thus, the first floor to be poured using the flying forms — together with the appropriate walls or columns for the next floor — is then poured using flying concrete forming structures. In the usual case, a second set of flying forms — as noted, generally one for each bay being formed — is then placed on the concrete floor after sufficient time has passed that the curing concrete will at least support the weight of the concrete forming structure or flying form to be placed on it, as well as the weight and impact of boots, etc. of the workers. Suitable column or flying wall forms are also placed, and the next poured concrete floor is formed. At this time, the first poured concrete floor may be sufficiently cured to permit removal from beneath it of the first set of concrete forming structures — the flying forms — on which that floor was poured. Otherwise, a third set of flying forms may be placed on the second poured floor using suitable tower, mobile, or self-climbing cranes — together with the appropriate column or wall forms — and a third concrete floor is then poured. Usually, by this time, the first floor which was poured will have sufficiently cured to permit removal of the first set of flying forms, if they have not already been removed for construction of the third floor. When very large floors are being poured, one set of forms may be used for the entire floor by pouring it in sections and flying the forms sideways to a new section after the concrete has sufficiently cured. In all events, the poured floors are re-shored while construction continues above them.

In order to remove the flying forms for concrete floors, they are first lowered from the underside of the concrete floor which was poured by them, and then they are pushed outwardly from the building and secured to suitable cables extending downwardly from the outwardly extending arm of a crane. Each form is then flow by lifting it upwardly with the crane and placing it on the most recently poured concrete floor, together with appropriate column or wall forms, for use as a concrete forming structure on which yet another concrete floor is to be poured. Therefore, in the usual case, a flying form is used as a concrete forming structure in a bay which may be many storeys high, by "leap-frogging" the flying form past one or two other flying forms and placing it on the then uppermost poured concrete floor in order that yet another floor can be poured on it, and so on. Thus, as few as one — but usually two — flying floor forms per bay may be required for the construction of a multi-storeyed high-rise building. Similarly, one or more sets of flying wall forms per bay may be used.

It should be noted, however, that flying forms may be very heavy, and that tower, mobile or self-climbing cranes are restricted as to the weight that they can handle — particularly when the lifting point is considerably far out on the horizontal lifting arm of the crane. However, these problems can be overcome by the use of flying forms as concrete forming structures where the truss, chord, and beam members are formed of aluminum. In any event, this invention provides a flying form as a concrete forming structure wherein the deck on which a concrete floor is to be poured or the facing for a wall form, is easily and readily secured to the upper edges of a plurality of beams. For floor forming, the beams are set transversely across a pair of truss members; and for wall forming, the beams are secured to stiffeners.

As noted, the horizontal flying forms which are used for forming concrete floors comprise a deck which is secured to a plurality of beams which are set transversely across a pair of truss members. A vertical form which is used for wall forming comprises a face which is secured to a plurality or horizontal beams which are secured to vertical stiffeners. The decks and the faces of such flying forms are generally plywood, which may be treated for use in concrete forming structures, and in a flying form the sheets of plywood are all secured by fastening them in a convenient manner to the beams which are beneath or behind the plywood sheeting. However, it is difficult to secure wooden sheeting to metal beams in a manner so that the sheeting can be replaced from time to time. Thus, this invention provides a beam which has an upper section which is generally in the form of a inverted top hat which is open at its upper end. Because the beams are subjected to deflection forces, and may have a fairly wide span between trusses or stiffeners, this invention further provides that the beam has an independent beam stiffening joist member — generally, of rectangular cross-section — and having a crosswise dimension which is substantially equal to the average crosswise dimension of the open top hat section, and where the independent beam stiffening joist member is secured within the open inverted top hat section. The independent beam stiffening joist member is of a material — usually wood — so that the decking or facing may be secured to the beam by driveable fastening means such as nails or screws.

It should also be noted that decking which is secured across a plurality of beams according to this invention may be placed on other supporting structures than truss structures which are integral with the beams, for use below ground level, and for use in non-standard ceiling height areas or areas where there may be varying or sloping ceiling heights — such as underground parking areas for apartment and office buildings. In such circumstances, however, panels may in any event be formed which can be more easily and expeditiously handled or flown than a plurality of plywood sheets and separate beams might, for example, be handled.

BRIEF DISCUSSION OF THE PRIOR ART

Previously, devices such as the forming structure disclosed in Gostling U.S. Pat. No. 3,438,160, issued Apr. 15, 1969, have included a plurality of scaffold members on which a wooden superstructure is constructed, including a plurality of lengthwise load-bearing timbers, across which are secured a number of crosswise beams or joists to which a decking or sheeting material may be nailed. However, because of the limited load-bearing capacities of wood, a considerable number of wooden joist or beam members are required; and as well, a special lifting device is required because it is not possible to move such a structure with scaffolding supports lengthwise, without collapsing the same.

It has been suggested that the crosswise joists of a structure such as the Gostling structure might be replaced with metallic framing structures of the sort disclosed in Riddle U.S. Pat. No. 1,475,409 issued Nov. 27, 1923 or Roush U.S. Pat. No. 2,085,472 issued June 29, 1937. Those framing structures, however, are formed of sheet metal which may be bent and otherwise worked in the usual manner of sheet metal working, and have nailing compounds which may include re-hydrated calcined gypsum, wood fibre and adhesive, or some other suitable nailing compound which can be placed in a channel while in a fluid or plastic state and which hardens after it has been placed. However, such nailing compounds are not generally adapted to permit removal of a nail or screw therefrom while maintaining the structural integrity of the nailing compound. More particularly, the load bearing capacities of structural members formed of sheet metal are very low, so that a very great number of such framing members would be required in a concrete forming structure, and each member could only have a very limited span because of the load forces which would be imposed upon it.

H. S. Dunn, in U.S. Pat. No. 3,027,984 issued Apr. 3, 1962, teaches a beam which embodies a composite shape that functions as both a channel and an I-beam. The beam, in its lower portion, has all of the characteristics of an I-beam, and in its upper portion comprises an upward facing channel into which it is contemplated that the ends of a downward facing channel and supporting tubular braces might be inserted and held, either by bolts or gusset plates which would be welded in place. However, beams such as those contemplated by Dunn have no contemplation of any form of joist stiffening member nor of any form of member which might be inserted as a nailing or fastening member. Further, the Dunn beams lack flanges, and are not intended to support sheeting or decking and to distribute their load-bearing area against such sheeting over a wider area than simply that of the channel. Indeed, Dunn contemplates the use of additional channels together with extruded vinyl beading to secure screening in place below the upper channel so as to cover a patio or a swimming pool, or the like; and the anchoring channels are held by the lower, I-beam portion of the Dunn beam.

Snyder, in U.s. Pat. No. 1,586,053 issued May 25, 1926, discloses a number of alternatives for a metal beam, which, however, can be formed in two halves which are secured together such as by rivets. One of the primary purposes of the Synder beam is to provide a pair of upwardly extending flanges from a channel or a pair of overhanging shoulders which are formed by bending the upstanding flanges downwards to overlie a depressed portion. Various other alternative embodiments comprise combinations of different types of channels, and they may be formed by riveting, bolting or spot welding. In any event, a beam such as that shown by Snyder might accept the head of a bolt in certain embodiments in a depressed portion or channel, or it might accept a nailing compound or member in other embodiments; but the Snyder beam either has no load bearing flanges or no substantially open channel into which a beam stiffening member might be inserted. Further there is no contemplation by Snyder of the use of the beam other than for tieing other beams to it if the right embodiment is used, or welding, riveting or bolting other structural members to it.

Use of beam members in concrete forming structures, when the beam members are formed of extruded aluminum and have an independent beam stiffening member secured into an upper portion thereof, substantially overcomes all of the difficulties of the prior art. In particular, beam deflection resistance is enhanced by the independent beam stiffening member which is secured within the upper channel portion of a beam according to this invention; and at the same time, there is no working at or around welds, bolts or rivets or various elements that have been secured together to form the beam. Further, driveable fastening means may be inserted and removed from the beam stiffening member without destroying the same, and the beams themselves may be easily attached to other structural members simply by bolting them directly or by the use of clamping elements. Still further, a number of different ways — or a combination of them — may be used to secure an independent beam stiffening member in the upper channel or top hat section without destroying the integrity of either the beam stiffening member or the beam itself. Finally, considerable weight advantages from the use of extruded aluminum can be realized as discussed in greater detail hereafter.

BRIEF SUMMARY OF THE INVENTION

It is a purpose of this invention to provide concrete forming structures which comprise beams and other structural elements, together with a substantially planar sheeting on or against which concrete may be poured, and which may be moved substantially as integral structures; wherein the beam structures are provided so that the substantially planar sheeting can be readily and easily secured thereto.

A further object of this invention is to provide concrete forming structures which are useful as "flying forms" for use in the construction of high-rise buildings, and to teach a method of construction using such concrete forming structures.

A still further object of this invention is to provide concrete forming structures which may be made of extruded aluminum, and whose size may be greatly increased over similar structures formed of steel or wood.

Yet another object of this invention is to provide concrete forming structures in which means are provided to support the structures and to adjust them for desired levels, heights or thicknesses of the concrete to be placed.

BRIEF DESCRIPTION OF THE DRAWINGS

These and other purposes, objects and features of this invention are discussed in greater detail hereafter in association with the accompanying drawings, in which.

DESCRIPTION OF THE PREFERRED EMBODIMENTS

Figure 1:
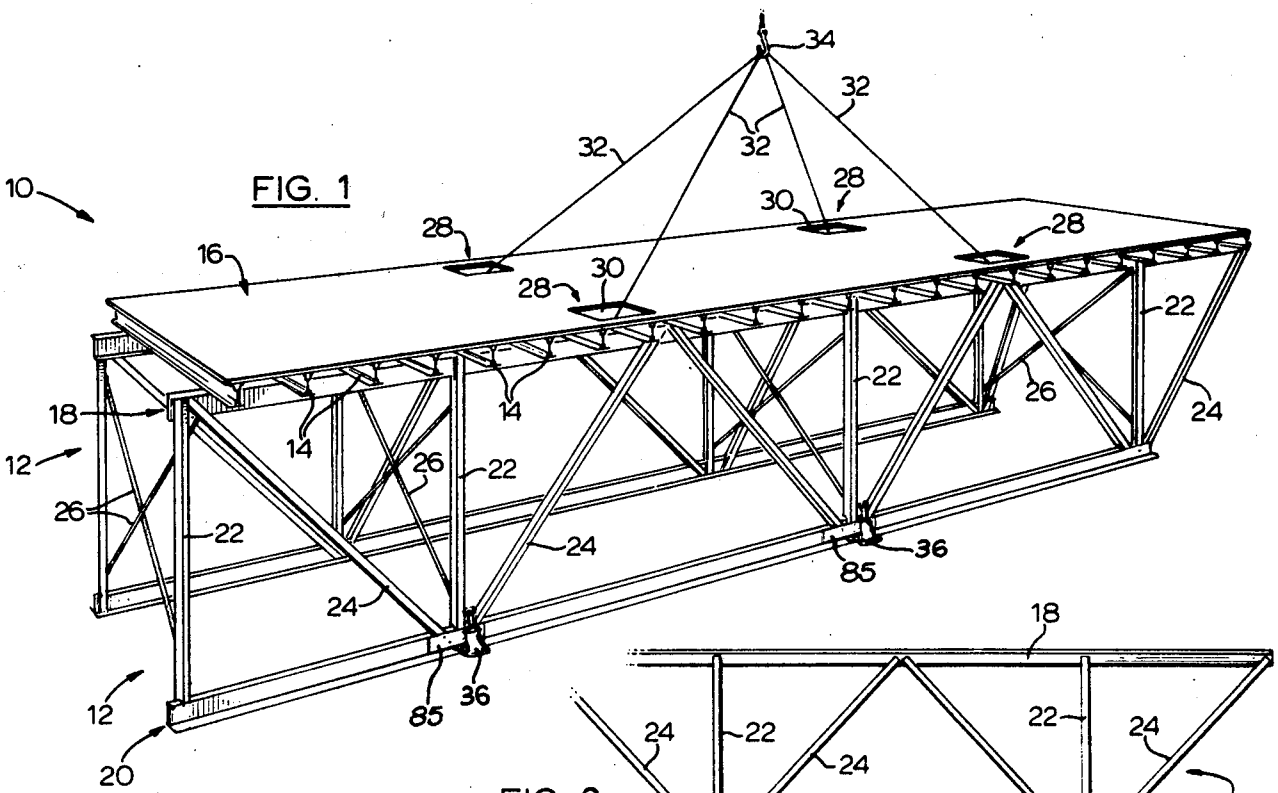
FIG. 1 is a perspective view showing a portion of a concrete forming structure according to this invention, and being used as a flying form.

A flying form which is useful as a concrete forming structure for forming floors, as discussed above, is shown in FIG. 1 and is indicated generally at 10. That concrete forming structure is a flying form in accordance with this invention, and comprises a plurality of trusses indicated generally at 12, a plurality of beams indicated generally at 14, and an upper deck indicated generally at 16. Each truss has upper and lower chord members 18 and 20, vertical and diagonal truss members 22 and 24, and cross-tierods 26. The flying form 10 has pickup points indicated at 28 in openings or ports 30, and is adapted to be picked up by a saddle comprising cables 32 suspended from hook 34. Each end of a truss 12 may have a diagonal member 24 as shown at the right end of a truss in FIG. 1, or a vertical member 22 as shown at the left end of the same structures, depending on the length of the truss and other design considerations. In any event, it will be seen that the flying form 10 is an integral structure comprising in this case, two substantially parallel trusses 12 having beams 14 placed transversely across the upper ends of the trusses on upper chord members 18, and with an upper deck 16 secured to the upper edges of the beams 14.

Figure 2:
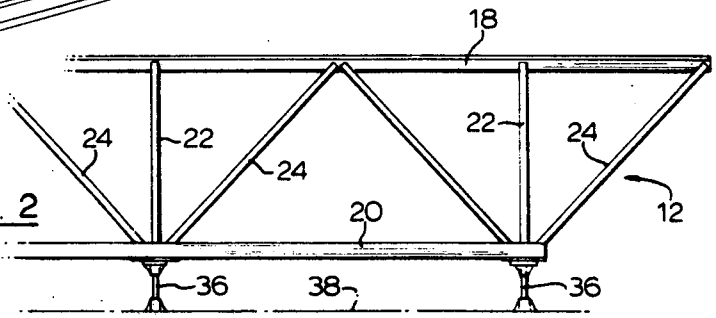
FIG. 2 is a side view of a portion of a truss of a concrete forming structure according to this invention.

FIG. 2 is a partial view showing the side of a truss portion of a concrete forming structure 10 according to this invention, wherein the bottom of each truss 12 is supported by screwjacks 36 which are in place beneath the lower chord member 20. The screwjacks 36 are shown placed substantially beneath the lower ends of the vertical truss members 22 and below the points where vertical members 22 and diagonal members 24 attach to the lower chord member 20, in order to take up vertical loading. Screwjacks such as 36 are used beneath the trusses 12 of a flying form 10 in order to adjust the height of the upper deck 16 above the floor — such as that indicated at 38 in FIG. 2 — on which the flying form 10 is located; thereby accommodating adjustment of the height of the lower side of a poured concrete floor above the upper side of the next lower poured concrete floor. The screwjacks are shown swung up for movement or flying of the form 10, in FIG. 1.

It will also be noted in FIG. 1 that the outer ends of the beams 14 extend beyond the upper chord members 18 of trusses 12. The sideways span of the concrete forming structure 10 — and thus, of the concrete floor which may be poured on that structure — may thus be determined by the allowable limit to which the beams 14 may be permitted to extend or cantilever beyond the beam members 18 plus the permissible distance between trusses 12, considering the concrete and other static loads which the structure is designed to withstand.

Figure 3:
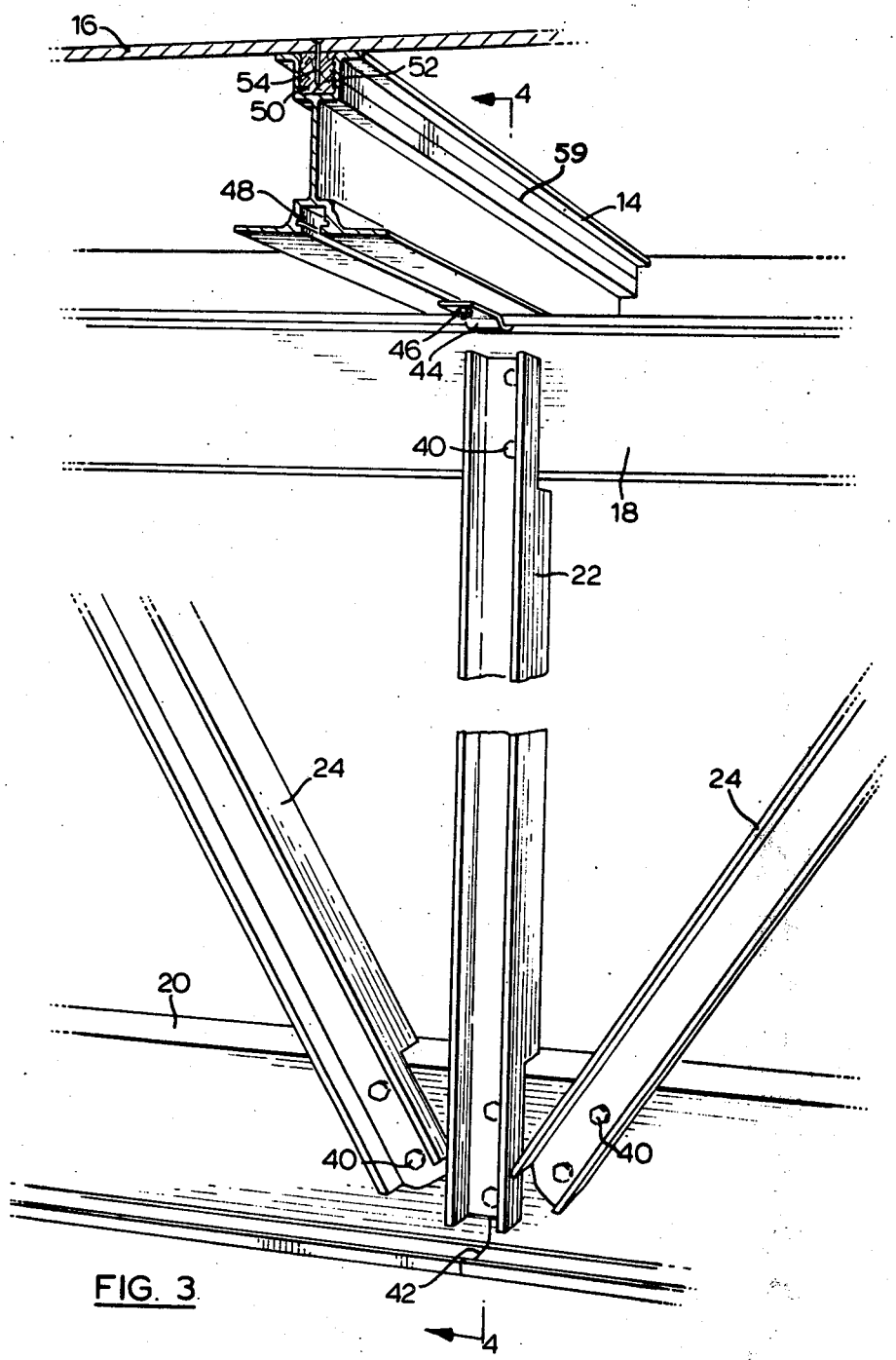
FIG. 3 is a perspective view to a much larger scale showing details of a truss and beam assembly of a concrete forming structure according to this invention.

Turning to FIG. 3, the construction of a horizontal concrete forming structure 10 for floor forming, according to this invention, is illustrated in greater detail, and the following discussion is intended as exemplary of such concrete forming structures according to this invention. As well, certain principles of the use of beam members 14 in accordance with the present invention are discussed, and are further discussed and illustrated hereafter in association with other types of concrete forming structure in accordance with this invention.

For ease of assembly at the construction site, especially when a concrete forming structure is fabricated from aluminum as discussed hereafter, the entire concrete forming structure may be bolted together using well-known techniques. Thus, each of the truss members 22 may be bolted to the upper or lower chord members 18 or 20 using bolts 40. A seam is indicated at 42 in FIG. 3 in the lower beam member 20 of the truss, and a plate 85 is shown in FIG. 1 on the outside of the individual chord members 20. Alternative embodiments and arrangements may be made, as discussed hereafter. A plurality of beams 14 are placed transversely across a pair of substantially parallel trusses 12, and may be secured to the upper chord members 18 of the trusses by bolting. Such arrangements may include bolts passed through the lower flange of the beam 14 and the upper flange of the chord 18, but in the usual case brackets 44 clamp to the chord 18 and are secured by bolts 46 within channels 48 which are formed in the beam 14. The upper deck 16 is shown secured to an independent joist member 50 which is secured in the upper portion of the beam 14. This arrangement is discussed in greater detail hereafter.

Figure 4:
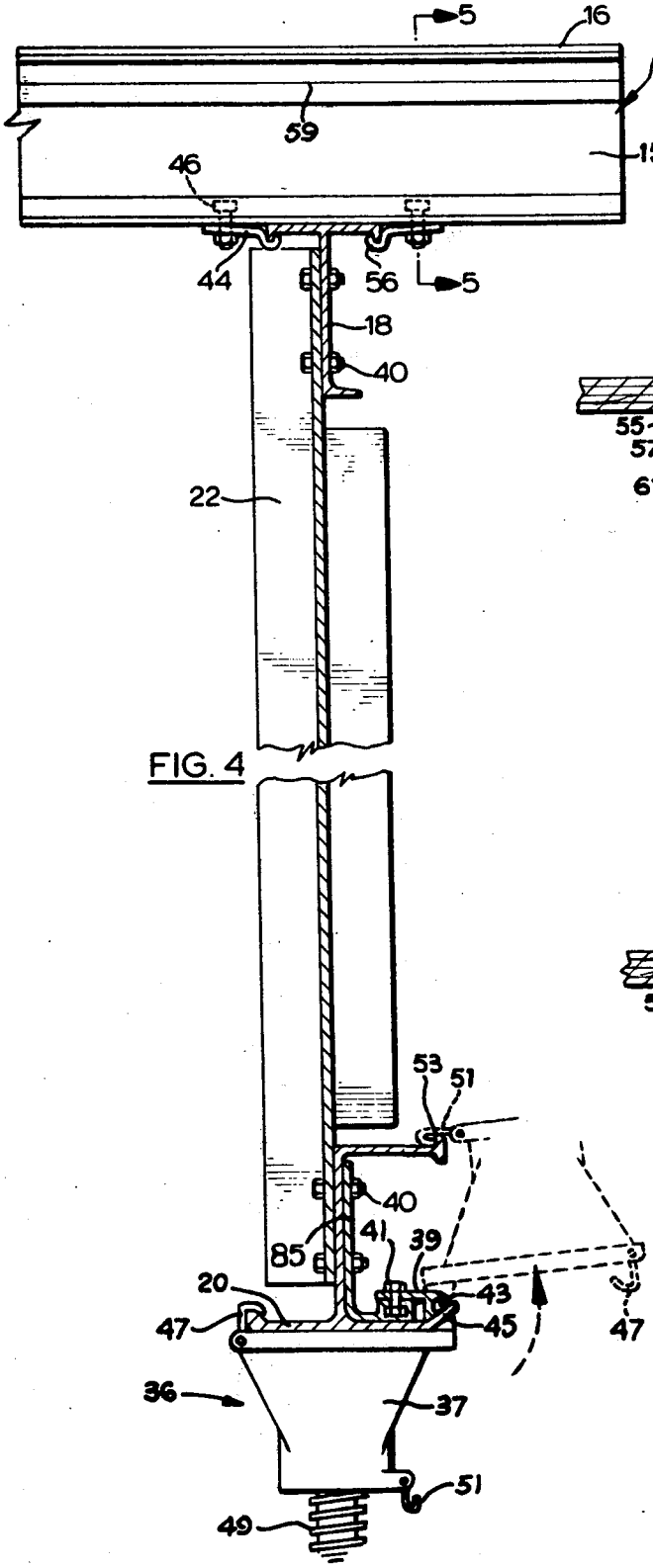
FIG. 4 is a sectional view along the line 4—4 in FIG. 3 and showing a typical supporting structure in alternate positions.

In FIG. 4 there are further details of the bolting arrangements whereby a truss 12 may be formed; including a truss member 22, an upper chord member 18, a lower chord member 20 and bolts 40 with suitable nuts and locking arrangements as are well known in the art. It will be noted that brackets 44 may be adapted to secure the beam 14 to the chord member 18 by a substantially hook-like formation 56 at one end of the brackets 44.

Figure 5:
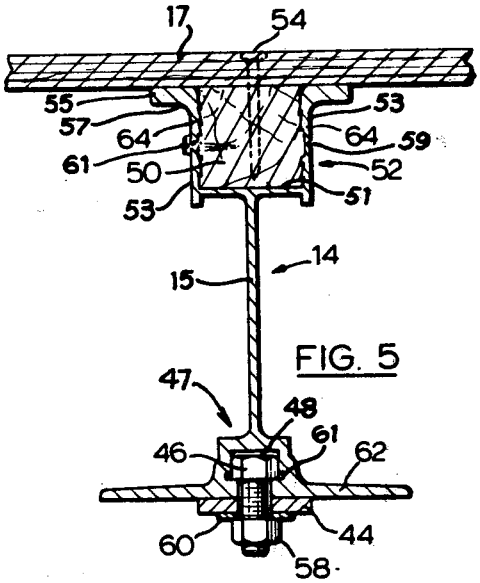
FIG. 5 is a sectional view of a beam, taken along the line 5—5 in FIG. 4.

Referring to the lower portion of the beam member 14 illustrated in FIG. 5, it will be seen that a washer 60 may be used with nut 58, and that tightening of the nut 58 on bolt 46 and against the bracket 44 brings the bracket 44 into intimate engagement with the lower side of the lower flange 62 of the beam 14. Movement of the beam 14 in any direction is thereby substantially precluded. The slot 48 which is formed longitudinally in beam 14 is generally T-shaped, with the upper section being wider than the lower section so as to accommodate the head and shank of bolt 46, respectively. The upper section of slot 48 may be widened as at 61 in order to accommodate a washer beneath the head of bolt 46, if necessary, soas to preclude localized stress beyond the yield point of the material of the beam 14 beneath the bolt head.

The upper portion of a beam 14 has an upper section in the form of an inverted top hat which is open at its upper end. This is indicated generally at 52, and comprises a horizontally extending bottom 51 and a pair of substantially parallel side walls 53 which extend vertically upwards from bottom 51. The web portion 15 of beam 14 is formed between the upper portion 52 and the base portion 47 substantially along the entire length of the beam 14, so that any load forces which are applied to the beam at the upper portion 52 are transferred to the base portion 47 by the web portion 15 at any place along the length of the beam 14. The web portion 15 is beneath the upper portion 52.

A beam 14 in accordance with this invention, has, as noted, its upper portion 52 in the form of an inverted top hat which is open at its upper end. A pair of flanges 55 extend horizontally outwardly at the top of each side wall 53, respectively. In the usual case, the thickness of each of the flanges 55 is greater than the thickness of its respective side wall 53, at least at its juncture therewith as indicated at 57.

A wooden joist member 50 is shown placed in the upper open top hat portion 52 of the beam 14. A suitable panel such as a sheet of plywood 17 may be secured to the wooden joist member 50 by driveable means such as a nail or screw 54. The sheeting 17 may form the deck 16 of a flying form 10 as discussed above, or the facing of other concrete forming structures discussed in greater detail hereafter.

Figure 6:
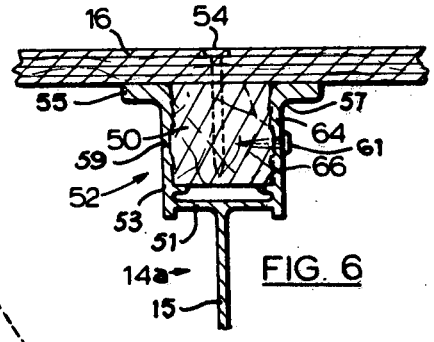
FIG. 6 is a sectional view similar to that shown in FIG. 5 of an alternative embodiment of a beam according to this invention.

FIG. 6 shows an alternative arrangement for an open inverted top hat section 52 in the upper portion of a beam **14*a*. In this case, stops 66 are formed to extend into the top hat section from side walls 53, above the bottom 51, so as to preclude downward movement of a wooden joist member 50 past the stops 66. This cross section is used where it is otherwise desired to have a different web arrangement in the extruded section forming the beam 14*a***, with a different cross-sectional area, and is particularly used for drop-beam forming.

The inverted top hat section 52 in the upper portion of a beam 14 (or **14*a*) may have a plurality of inwardly facing ridges 64 formed in each side wall 53 thereof. The ridges are shaped so as to grip the side of the wooden joist member 50; and they may have a downwardly directed saw tooth configuration, or they may simply be ridges which extend inwardly into the wooden joist member 50 thereby slightly compressing the material thereof in the vicinity of the ridges. Further, there may be a fastening device 61 — such as a self-tapping screw or a ramset fastener — projecting through either or both side walls 53 into the joist member 50. An outwardly facing groove 59 may be formed in the outer side of each side wall 53, to provide a guide or starting point from which fastener 61 may be driven through the side wall 53 and into the joist member 50. An epoxy or other suitable adhesive may also be used to secure the joist member 50 in upper portion 52 of a beam 14**.

Typically, the inverted top hat open section 52 at the upper end of a beam 14 is dimensioned so as to take a wooden joist member of construction grade lumber, nominally 2 inches by 2 inches in cross-section or of such other dimensions as may be desired. The wooden joist member 50 may be forced into the open top hat section by hammering the wood downwardly into the section; and in any event, when it is secured, upward motion thereof is essentially precluded. As noted, the joist member 50 may be secured by the interference of the ridges 64 with the sides of the joist member 50 or by fasteners 61, or by an adhesive, or any combination of them.

It should be noted that the beam members 14 — which are essentially I-beams having an open, inverted top hat section in their upper portion — will have an increased resistance to deflection when a joist member 50 is secured in the top hat section as discussed above, as compared to a standard I-beam configuration having the identical cross-sectional area of the same metal. Indeed, the deflection resistance of an extruded aluminum I-beam section similar to that shown in FIG. 5 — and as indicated in FIG. 6 — and having a wooden joist member secured in the top hat section, is better than that of a standard I-beam made of steel and having equal weight per linear foot. It is this latter fact which leads to the great advantages of concrete forming structures according to this invention, when they are formed of extruded aluminum. It should also be noted that a beam 14 (or **14*a*) will function in the manner discussed above particularly when it is formed of extruded aluminum. Sections such as those of beams 14 or 14*a*** — or as discussed hereafter — would not normally be possible to obtain by rolling; and the joining together of rolled or formed sections such as by welding or riveting would normally result in a beam having lower ultimate strength and resistance to deflection, and having a greater likelihood of working failure of the beam in the vicinity of the places where the halves of such a beam are joined.

Figure 7:
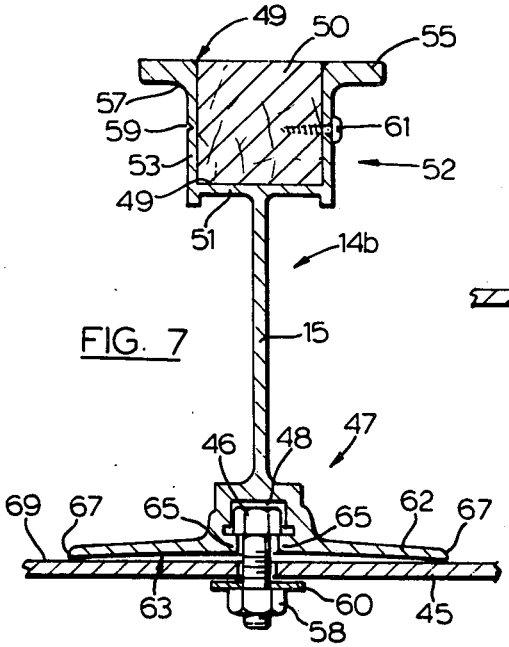
FIG. 7 is a sectional view similar to FIG. 5, but looking generally in the opposite direction.
Figure 8:
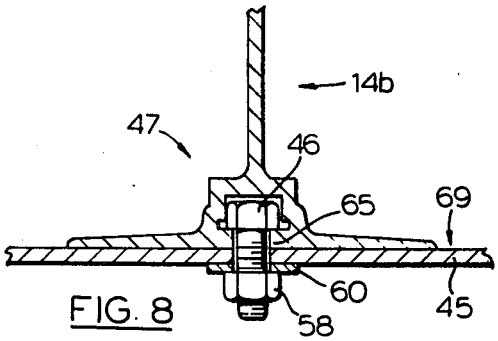
FIG. 8 is a sectional view of the lower portion of FIG. 7, but with a clamp in place.

FIGS. 7 and 8 are similar to FIG. 5, but show a further beam configuration **14*b* which is substantially identical to beam 14 except that the upper portion 52 has no ridges 64. The independent beam stiffening joist member 50 is, however, secured in the upper portion 52 of beam 14*b* by fasteners 61 projecting inwardly from at least one of the side walls 53 and forced into the independent joist member 50. In addition, a suitable adhesive may be spread on the joist member 50 or on the inside surfaces of side walls 53 and the upper surface of bottom 51, as at 49, to assist in securing the independent beam stiffening joist member 50 within the upper section 52 of beam 14*b***.

Considering FIGS. 7 and 8 as showing essentially identical features of beam **14*b* — at least in its lower portions — when viewed in a direction opposite to that of arrows 5—5 in FIG. 4, there is shown another feature of a beam such as beam 14*b*. That is, that the underside 63 of flanges 62 of the beam 14*b* may be slightly concave when the beam 14 is unstressed. Thus, the elevation of the points 65 at the edges of the lower section of slot 48 may be higher than either of the points 67 at the outer extremity of the flange 62. However, when the nut 58 is tightened on the shank of bolt 46, so as to draw the beam 14*b* downwardly towards the upper surface 69 of the item 45 — which may be bracket 44 or some other structural member — to which the beam is being attached, the points 65 and the entire lower surface 63 of the flange 62 are brought substantially into contact with the surface 69**, and a very secure connection between the beam and the other structural member is thereby assured. In addition, full load transfer over the entire area of contact is assured, without risk of localized stress beyond the yield point of the material of either the beam or the other structural elements to which it is attached.

It should also be noted that on a long horizontal span with an element such as an ordinary I-beam, a timber joist or any of the prior art beams, it is necessary when designing a concrete forming structure to consider the load bearing strength of the beams in view of a modified slenderness ratio, i.e. the ratio of the length of the beam with respect to its radius of gyration in the Y-axis. However, with a beam such as beam 14, **14*a* or 14*b*** as illustrated and discussed above, in accordance with this invention, where the independent beam stiffening joist member is secured in the upper portion of the beam, and the beam is used in a concrete forming structure where the decking or facing is secured to the beam stiffening joist member, it is possible to ignore the modified slenderness ratio and to consider the full strength of the material of the beam. In other words, it is possible to design a concrete forming structure according to this invention using a beam according to this invention where the design is made having consideration of the yield strength of the material of the beam — usually extruded aluminum — without modifying or reducing the considered yield strength because of an adverse slenderness ratio.

The use of the flanges 55 on beams 14, **14*a* or 14*b*, gives a much wider area for reaction forces to be transferred from the decking or facing of a concrete forming structure to the beam, compared with the identical beam without flanges. In addition, the unsupported span of sheeting between beams is lessened to some extent. Also, when the flange 55 is of a greater thickness than the side wall 53 of a beam such as beam 14, 14*a* or 14*b*** according to this invention, there is a greater moment of inertia realized because there is a greater mass of extruded aluminum at the furthest possible distance from the neutral axis of the beam. Thus, a beam having thicker flanges may have substantially the same moment of inertia as a higher beam whose flanges are not thicker than the side walls of the upper portion of the beam.

It has been disclosed that wood is the material which is used as the independent beam stiffening joist member 50; and it is an important feature of this invention that the beam stiffening joist member 50 has nail or screw (or other driveable fastening means) retaining and holding properties, as well as sufficient tensile strength and yield point, to provide beam deflection resistance and the capability of replacing concrete forming the sheeting 17 as discussed above. However, plastics technology may lead to the development of other materials than wood which would have essentially the same properties to serve the same purposes as noted. Such materials may include castible materials such as glass- or fiber-loaded epoxy, and other resin-based fillers or plastomers; as well as foamed-in-place high density urethane foam, or extruded urethane or vinyl.

Figure 9:
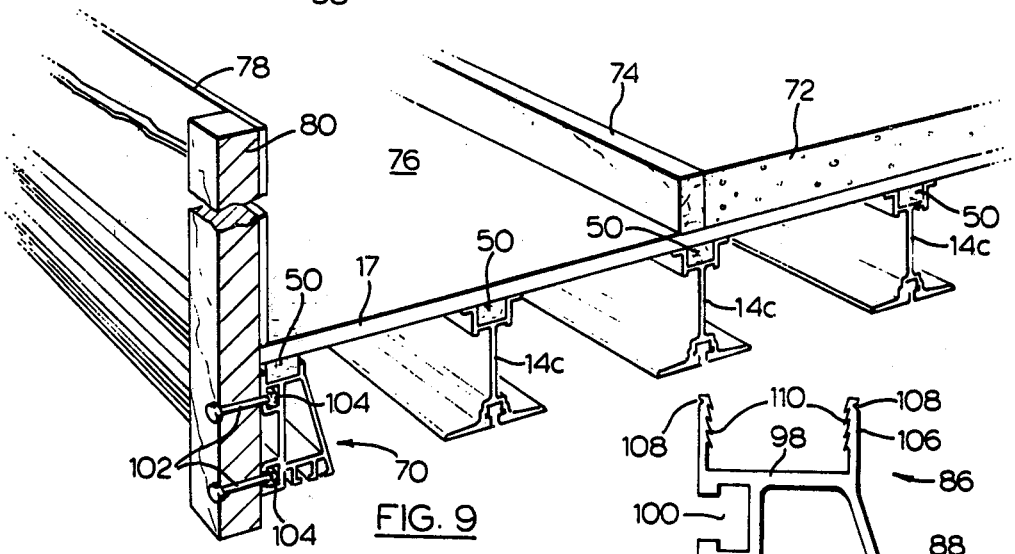
FIG. 9 is a perspective view of another concrete forming structure according to this invention using several types of beams.

Turning now to FIGS. 9 and 10, there is shown a portion of a modified concrete forming structure, utilizing a plurality of beams indicated at **14*c* — which would be similar, for example, to any of beams 14, 14*a* or 14*b* discussed above — and a beam 70 which is shown in FIG. 10** and discussed in greater detail hereafter. The concrete forming structure illustrated in FIG. 9 includes the forming sheeting 17 secured to the beams 14c such as by nailing into the beam stiffening joist member 50 of each of the beams. Concrete is shown at 72 placed on a portion of the sheeting 17, and having an edge form 74 which may be lumber having suitable dimensions. No concrete is placed over the sheeting 17 to the outside of edge form 74, so that a walkway 76 is formed on the outside of the concrete 72. A safety wall or railing 78 is secured to posts 80, and posts 80 are secured to the end-beam 70 as discussed hereafter in greater detail.

Figure 10:
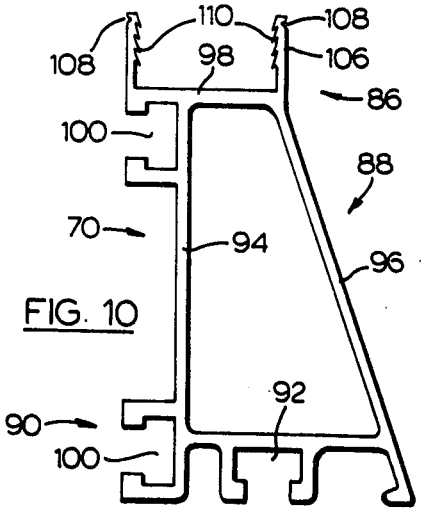
FIG. 10 is a sectional view of an alternative beam in accordance with this invention.

The beam 70 shown in FIG. 10 comprises an upper portion 86, a web portion 88 and a base portion 90. In the base portion 90 is a generally T-shaped slot 92, similar to the T-shaped slot 48 of any of the beams 14 discussed above. The slots 48 or 92 provide means for fastening the beams 14 or 70 to structural members such as trusses and truss cords, scaffolding, stringers, stiffeners, etc., and permits the attachment of special beam forms, spandrel forms, hinged panels, etc. to a concrete forming structure according to this invention.

The web portion 88 of the beam 70 comprises two webs 94 and 96 which extend generally downwardly from the bottom 98 of the upper portion 86 of the beam 70. In the specific form of beam 70 illustrated in FIG. 9 and 10, the web 94 extends from the bottom 98 of upper portion 86 to one side of the base portion 90, and the web 96 extends outwardly and downwardly to the other side of the base portion 90. On the outer side of the web 94, there is formed a pair of longitudinal, spaced apart slots 100 which are each generally T-shaped, similar to the longitudinal slot 92 formed in the base portion 90 of the beam 70. Each of slots 100 has inner and outer section where the width (measured vertically) of the inner section is greater than the width (measured vertically) of the outer section, so as to form the T-shape. The side slots 100 are particularly intended for use in such installations as illustrated in FIG. 9, where a guard panel or rail is secured to the concrete forming structure for the safety of persons who are working on it. A guard rail installation may be as illustrated in FIG. 9, where a pair of bolts 102 pass through the post 80 and are secured within the slots 100 as shown at 104. Special brackets or sockets which are adapted to fit into the slots 100 may also be provided, where the brackets or sockets are dimensioned to accept and support in a vertical orientation a post 80.

The upper portion 86 of the beam 70 has a bottom 98 and side walls 106, much as the upper section of any of the beams 14 have a bottom 51 and side walls 53. An outwardly facing groove 108 is formed in the outer surface of side walls 106 for the same purpose as groove 59 discussed above with respect to beams 14, and a plurality of ridges 110 may be formed on the inner surface of each of the side walls 106. It will be noted, however, that the height of the side walls 106 is less than the height of the side walls 53 of beams 14, so that the joist member 50 which is shown installed in the beam 70 in FIG. 9, extends above the upper ends of the side walls 106. There is no flange on either side of the upper portion 86 of the beam 70. The modifications to the upper portion are made because of the following design considerations.

It has been noted that there is a concrete layer 72 on the sheeting 17 to the inside of the edge form 74 of the concrete forming structure shown in FIG. 9, and there is no concrete in the walkway 76. In a typical situation, the concrete forming structure would be designed to support a live load of fifty pounds per square foot at all places and at any time; whereas the deadload in those areas of the concrete forming structure where concrete is poured is far higher than the deadload in those areas such as walkway 76. For example, for an eight inch slab of concrete, the design consideration of deadload is one hundred pounds per square foot, whereas in the area of walkway 76 the design consideration of deadload is negligible, being in the order of two pounds per square foot or less. It is therefore possible to remove the flanges from the end-beam 70 because its deadload carrying requirements are considerably less than of a beam 14. Further, removal of the flanges permits placing the slots 100 below the upper portion 86 of beam 70, so that a guard rail post 80 may be securely held to the outer surface of the respective side wall 106. Also, other bolt-on forms for up-turned or down-turned spandrels can be more easily fitted to the end-beam 70. However, consideration of the moment of inertia and the slenderness ratio of the endbeam 70 is essentially the same as that of any of the beams 14, because of the total cross-sectional area of the beam and mass which is spaced away from the neutral axis of the beam.

It has been noted above that the trusses 12 may be supported, when standing, on such devices as screwjacks 36. An arrangement is shown in FIG. 4 whereby the screwjack 36 can be swung out of the way as shown in FIG. 1 so that the flying form 10 can be moved outwardly on rollers, casters or the like, and then flown to its next working position. In general, the upper portion 37 of the screwjack 36 is adapted to fit beneath the lower chord member 20 of a truss 12 when in operation, and the entire screwjack assembly 36 is swung out of place and secured by a clip, as discussed hereinafter, for moving and flying the form 10.

A clamping plate 39 is secured by bolts 41 to the plate 85, in such a manner as to enclose a hinge pin 43 between the upper surface of lip 45 of the lower chord member 20 and the clamping plate 39. When the screwjack 36 is in place, a clip 47 is placed over the inner edge of the lower chord member 20 of the truss; and the height of the jack may be adjusted by turning the post 49 which has a screw thread into the upper and lower portions of the jack, in the usual manner. When the screwjack 37 is swung out of place, clip 47 is disengaged from the lower chord member 20 and clip 51 engages a profiled lip 53 on the upper flange of the lower chord member 20. Thus, the screwjack 36 may be hingedly attached to the truss 12 for use when required — i.e., when the flying form 10 is being used as a concrete forming structure — and the screwjack 36 may be swung out of the way in order for the flying form 10 to be moved.

Figure 11:
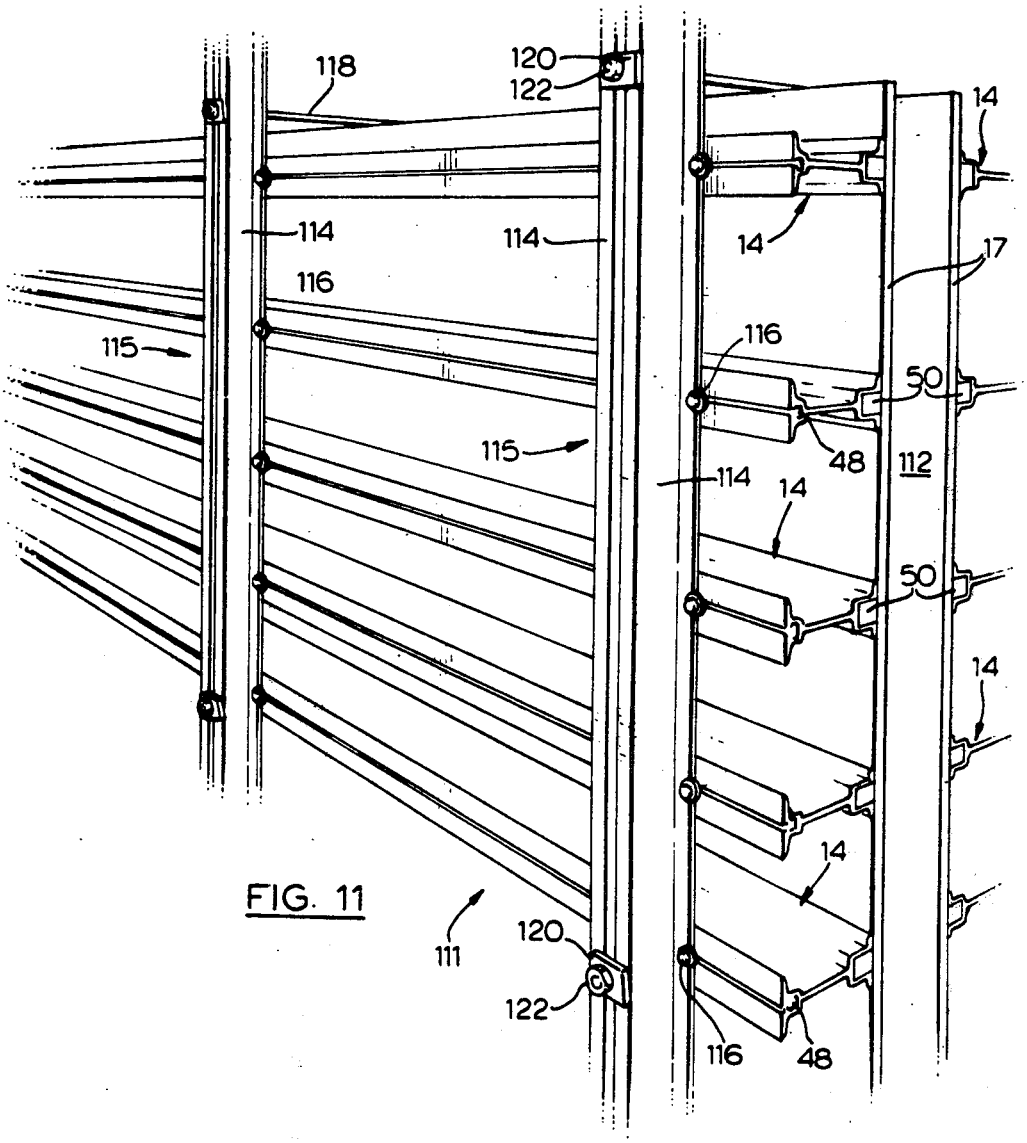
FIG. 11 is a perspective view of yet another concrete forming structure according to this invention.

Turning now to FIG. 11, there is shown yet another flying form in accordance with this invention, and indicated generally at 111. The concrete forming structure 111 is used together with a similar structure as a vertical form, so that a wall 112 may be poured between them. In the past, the usual wall form has comprised a plurality of vertical studs against which sheeting may be nailed, and the studs are backed up by a plurality of horizontal wales. In the wall form illustrated in FIG. 11, the sheeting or facing 17 is secured to a plurality of horizontal beams 14, where the upper portion of each of the beams 14 faces sideways rather than upwards. The spacing of the horizontal beams 14 is closer together at the bottom of the wall form 111 than at the top, because of the pressure gradient of fluid concrete which will be exerted outwardly against the wall forms 111 when the concrete is first placed between them. The beams 14 are secured to several stiffeners 115 — which may be comprise of back-to-back channel members 114 — by such means as bolts 116 secured within the slots 48 of the beams 14.

The wall forms 111 are held together by ties 118 which pass through the wall 112 and are secured to the stiffeners or "strong-backs" by such means as plate 120 and nuts 122 or other suitable fasteners which are secured to the ties 118. When the wall 112 has been placed and cured, and the wall forms 111 are removed, the ties 118 remain in place; however it will be noted that there is a necessity for far fewer ties 118 than in the usual case where wooden studs are placed closely together and backed by a number of wales.

For any given wall thickness, a pair of flying concrete wall forms 111 can be assembled elsewhere on the job-site — or off the job-site — and they may be easily flown and placed into position. When compared with a conventional wall form having studs and wales each formed of timbers having nominal four inches by four inches cross-sectional dimensions, there are fewer horizontal members in wall form 111 and considerably fewer vertical members, so that the weight of the wall form 111 — even when the beams 14 are formed of extruded aluminum and the stiffeners 115 are conventional steel channel — is considerably less than a wooden wall form designed for the same lateral loading. Also as noted above, the wall form 111 according to this invention may be assembled other than at the work-site, whereas wooden wall forms of any great size may be too heavy to be assembled elsewhere, but require considerably more labour because they must be assembled each time a wall is to be poured. Of course, beams 14 could be used as the studs in the more usual wall forming manner, backed by suitable wales; and fewer ties through the poured wall would be required because of the higher deflection resistance of the beams than of conventional wooden studs.

It has been noted, therefore, that a concrete forming panel may be assembled, which comprises a plurality of sheets of material 17 secured to a plurality of beams 14 and/or 70, where the sheets 17 are secured to the beams by driveable fastening means which are driven through the sheets and into independent beam stiffening joist members 50 which are secured in the beams 14 and/or 70. Such a concrete forming panel may then be secured to additional structural members so that the panel can be moved as an integral unit, by such means by bolting using bolt slots 48 and 92 or 100 formed in the beams, as discussed above. Such additional structural members to which the concrete forming panel may be secured would include a plurality of spaced apart stiffener members — in which case, a wall form has been assembled — or at least a pair of spaced apart truss members — in which case, a concrete floor form has been assembled. Integral panels may also be suspended from the column or wall-mounted tie-points for use as floor forms.

As noted above, in the usual circumstances at least the beam members according to this invention, and the chords and truss members of trusses, are all formed of extruded aluminum. The concrete forming structure which is thereby achieved is one which is an integral structure, and which can be moved as a single unit.

Thus, the use of concrete forming structures in accordance with this invention permits a number of horizontal floor forms to be placed side-by-side or end-to-end for forming a large floor area with a minimum of handling and without the necessity of handling and assembling individual scaffolding, planking, sheeting and decking, etc. The set-up and handling time is thereby considerably reduced.

In the usual circumstances, the bottom flanges 62 of any of the beams 14, **14*a* or 14*b* discussed above, are wider than the width of the beam at flanges 55. Thus, a more stable beam is assured, requiring a higher overturning moment than a standard I-beam section whose width is the same as that of the beams 14 at flanges 55. Also, because of the mass of metal in the flanges 62**, spaced away from the neutral axis of the beam there is a higher moment of inertia of the beam.

When a horizontal flying form such as flying form 10 is to be removed and "flown" to another position for re-use, the screwjacks 36 are adjusted so as to decrease the overall height of the concrete forming structure, and so as to permit the flying form 10 to be lowered onto rollers or casters. The form may then be pushed out of the bay from between the walls or columns which define its sides, and flown to next working position. At the same time, wall forms such as wall form 11 of FIG. 11 can be flown and placed. Also, flying forms have walkways such as walkway 76 shown in FIG. 9 may be used in certain circumstances, and extensions may be added to the ends or sides of flying forms in some circumstances to provide an additional deck on which a small concrete pad such as an apartment balcony may be poured. Still further, up-turned or down-turned spandrel forms may be bolted to a flying form — either horizontal or vertical forms — as required; and beam forms may be attached to a flying form.

A practical flying form such as flying form 10 having a deck area of about 1600 square feet, 20 feet by 80 feet), weighs aproximately five pounds per square foot when it is made of extruded aluminum. Such flying forms are of a weight that they can be moved and lifted by tower, mobile or self-climbing cranes of known design. By contrast, a similar flying form made of steel — having the same load bearing characteristics and therefor fewer beams — would, in any event weigh approximately twice as much per square foot. Therefore, for a given crane capacity, twice as much handling would be required to move two concrete forming structures when made of steel than to move one aluminum flying form in accordance with this invention. In addition, the use of extruded aluminum in special shapes provides the most economic use of the metal.

In a flying form having the same load bearing characteristics as the flying form 10 illustrated in FIG. 1 is made of wood, and is intended for use in forming eight inch thick concrete floors, wooden joists having cross-sectional dimensions two inches by twelve inches must be placed at twelve inch centres, and a massive wooden truss would be required, so that a similar flying form might be approximately 2.5 times heavier than one which is made of extruded aluminum.

It will be appreciated that construction costs can be considerably reduced by the use of flying forms in accordance with the invention. In particular, a reduction in the number of skilled and semi-skilled workmen may be effected, as well as a reduction in capital outlay or rental costs for concrete forming equipment. Further, there is considerably less wastage of materials, it being necessary only to replace the decking or sheeting, and the independent beam stiffening wooden joist members — and even then only occasionally. The scrap value of aluminum relative to its new price is considerably higher than the scrap value of steel relative to its new price; and lighter and larger structures which require less handling can be prepared from extruded aluminum as compared with steel. Because of the bolted assembly of flying forms according to this invention, any concrete forming structure may be shipped to the construction site in knocked-down condition for assembly "on the job".

The use of an independent beam stiffening joist member which is secured in the upper portion of a beam according to this invention, enhances the deflection resistance of the beam, and thereby permits wide spans of the beam between and beyond the trusses or stiffeners to which it or a number of such beams are secured. Further, by using a wooden beam stiffening joist member, the sheeting which comprises the deck or face of a concrete forming structure according to this invention may be easily secured to the structure merely by driving nails into the beam stiffening joist members. Thus, the sheeting may be easily repaired or replaced, without regard to expensive or complicated arrangements by which the sheeting may be fastened to the supporting structures. The screwjacks which are discussed above may be replaced with conventional screwjacks, postjacks, telescoping legs of other means such as hydraulic jacks.

The above description and the accompanying drawings relate to specific embodiments of concrete forming structures or "flying forms" according to this invention. The description, claims and drawings have used such terminology as "horizontal" and "vertical" with respect to features of the beams that have been taught; but it is obvious that, for example, the "vertically extending" side walls of the upper portion of a beam according to this invention are so stated with respect to the base portion of the beam, and that the beams may have any orientation with respect to the ground — such as the beams illustrated in FIG. 11. Other changes and amendments with respect to the structures, their nature of assembly and the materials used can be made without departing from the spirit or scope of the appended claims.

I claim:

1. For use with concrete forming structures of the type employing a plurality of beams positioned to support loads exerted thereon through panels supported thereby and secured thereto, an extruded aluminum beam having a unitary structure and a constant cross-section throughout its length, and having base, web and top hat portions, where;

said base portion has a pair of outwardly extending base flanges defining a load-transmitting side of said beam remote from the said top hat portion, and a generally T-shaped slot formed longitudinally therein, said slot being suitable for receiving and retaining a bolt head and being substantially symmetrical between said base flanges;

said T-shaped slot includes a wall member perpendicularly intersecting said web portion and a pair of parallel slot side walls extending generally perpendicularly from said wall member towards said base flanges;

said web portion is formed between said top hat portion and said base portion along the longitudinal axis of said beam and substantially along the entire length thereof so as to be able to transfer load forces from said upper portion to said base portion at any place along the length of said beam; and said top hat portion is in the form of an inverted top hat, having a channel which is open entirely along the length of a panel-supporting side of said beam remote from said base portion for receiving an independent beam-stiffening joist member therein, said channel including a first wall intersecting and generally perpendicular to said web portion, and channel side walls extending generally perpendicularly from said first wall and away from said web portion; and a pair of top hat flanged extending outwardly and generally perpendicularly from said first wall and away form said web portion; and a pair of top hat flanges extending outwardly and generally perpendicularly to said pair of channel side walls, respectively, the surfaces of said top hat flanges remote from said web portion being generally planar and defining a panel-supporting portion of said beam at said panel-supporting side thereof;

wherein the width and height of said inverted top hat channel are each substantially greater than the width and height respectively, of said T-shaped slot;

wherein the thickness of said top hat flanges in the direction of the applied load force is greater than the thickness of said channel side walls of said upper portion;

wherein the overall distance between the outer extremities of said base flanges is greater than the overall distance between the outer extremities of said top hat flanges; and wherein the lower surfaces of said base flanges are formed so that when said beam is substantially unstressed, the load-transmitting surface thereof which is defined by said lower surfaces of said base flanges is concave from side-to-side; and where a beam-stiffening joist member having a width substantially equal to the spacing between said side walls of said open channel portion of said top hat portion and a maximum height not greater than the height of said channel side walls is forced downwardly into said open channel through said open top, and is secured in said open channel portion by drivable means passing through at least one of the side walls of said open channel portion and into said beam-stiffening joist member so as to thereby preclude the inadvertent removal of said independent beam-stiffening joist member from said open channel.

2. The combination of claim 1, where said independent beam-stiffening joist member is wood.

3. The beam of claim 1 where a shallow outward facing groove is formed in the outer side of each side wall of said top hat portion.

4. The beam of claim 1 where a plurality of ridges project inwardly from at least one of said open channel side walls.

5. The beam of claim 1 where said independent beam-stiffening joist member may be further secured in said open channel of said inverted top hat portion of said beam by an adhesive.

6. For use with concrete forming structures of the type employing a plurality of beams positioned to support loads exerted thereon through panels supported thereby and secured thereto; an extruded aluminum beam having a unitary structure and a constant cross-section throughout its length, and having base, web and channel portions, where;

said web portion is formed between said channel portion and said base portion substantially along the entire length of said beam so as to be able to transfer load forces from said channel portion to said base portion at any place along the length of said beam, and comprises first and second webs which are spaced laterally apart;

said channel portion comprises a first wall intersecting and generally perpendicular to said first web of said web portion, and substantially parallel channel side walls extending generally perpendicularly from said first wall and away from said web portion;

said base portion has a generally T-shaped slot formed longitudinally therein, said slot being suitable for receiving and retaining a bolt head; said T-shaped slot including a wall member which is substantially parallel to the first wall of said channel portion and a pair of parallel slot side walls extending generally perpendicularly from said wall member in a direction away from said channel portion;

wherein said first web member has a pair of spaced apart generally T-shaped slots formed longitudinally on the side thereof remote from the said second web member, where each of said T-shaped slots is suitable for receiving and retaining a bolt head; and each of said slots has a pair of parallel slot side walls which extend generally perpendicularly from said first web member away from said second web member;

wherein said second web member diverges from said first web member in a direction towards said base portion;

wherein each of said first web member and said second web member extend beyond a base wall which comprises extensions of said first wall of said generally T-shaped slot formed in said base portion, parallel to said first wall of said channel portion;

wherein the closer slot side wall to said channel portion of the one of said T-shaped slot members which is closer to said channel portion is a portion of said first wall of said channel portion; and where the outer edge of the outer section of each of said pair of spaced apart slots on said first web member is substantially co-planar with the outer side of one of the side walls of said channel portion of said beam.

7. The beam of claim 6, where a shallow outward facing groove is formed in the outer side of each side wall of said channel portion.

8. The beam of claim 6, further comprising:

an independent beam-stiffening joist member of substantially rectangular cross-section with a crosswise dimension substantially equal to the average crosswise dimension between said side walls of said channel portions;

where said beam-stiffening joist member is secured in said channel portion so as to preclude movement therefrom in a direction away from said web portion and so as to increase the deflection resistance of said beam.

9. The combination of claim 8, where said independent beam-stiffening joist member is wood.

10. The beam of claim 8, where said independent beam-stiffening joist member is secured in said channel portion by means projecting inwardly from at least one of said channel walls and forced into said beam-stiffening joist member.

11. The beam of claim 8 where said means projecting inwardly from at least one of said channel side walls comprises a plurality of ridges.

12. The beam of claim 8 where said means projecting inwardly from at least one of said channel side walls comprises a drivable fastening device extending through said at least one side wall.

13. The beam of claim 8 where said independent beam-stiffening joist member is secured in said channel portion of said beam by an adhesive.

* * * * *

Disclaimer 4,144,690.—*Peter J. Avery,* Toronto, Canada. CONCRETE FORMING STRUCTURES. Patent dated Mar. 20, 1979. Disclaimer filed Jan. 11, 1983, by the assignee, *Aluma Systems, Inc.*

Hereby enters this disclaimer to claims 1 through 5 of said patent.

[*Official Gazette September 20, 1983.*]